US010068722B2

(12) United States Patent
Luo

(10) Patent No.: US 10,068,722 B2
(45) Date of Patent: Sep. 4, 2018

(54) PUSH-BUTTON STRUCTURE AND ELECTRONIC DEVICE WITH THE SAME

(71) Applicant: NANNING FUGUI PRECISION INDUSTRIAL CO., LTD., Nanning (CN)

(72) Inventor: Jian Luo, Shenzhen (CN)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 0 days.

(21) Appl. No.: 15/246,531

(22) Filed: Aug. 24, 2016

(65) Prior Publication Data

US 2017/0154740 A1 Jun. 1, 2017

(30) Foreign Application Priority Data

Nov. 27, 2015 (CN) ..... 2015 1 0840671

(51) Int. Cl.
*H01H 13/02* (2006.01)

(52) U.S. Cl.
CPC ..... *H01H 13/023* (2013.01); *H01H 2219/054* (2013.01); *H01H 2219/062* (2013.01); *H01H 2219/064* (2013.01)

(58) Field of Classification Search
CPC ..... H01H 13/023; H01H 13/52; H01H 13/22; H01H 2219/054; H01H 2219/062; H01H 2219/064
USPC ..... 200/314, 343
See application file for complete search history.

(56) References Cited

U.S. PATENT DOCUMENTS 4,136,270 A * 1/1979 Wernet ..... H01H 13/14 200/343
4,613,853 A * 9/1986 Hosogoe ..... G06F 3/03543 200/343
5,828,364 A * 10/1998 Siddiqui ..... G06F 3/0312 200/5 R
6,074,552 A * 6/2000 Allen ..... H01H 9/04 200/50.1
6,462,291 B1 * 10/2002 Sachs ..... G07C 9/00944 200/302.2
7,129,432 B2 * 10/2006 Fujii ..... H01H 9/182 200/310
7,244,898 B2 * 7/2007 Kim ..... H01H 13/83 200/314
8,294,053 B2 * 10/2012 Shimura ..... H01H 13/06 200/302.2

(Continued)

FOREIGN PATENT DOCUMENTS

CN 1892951 A 1/2007
CN 101399127 A 4/2009
CN 201397948 Y 2/2010

*Primary Examiner* — Felix O Figueroa
(74) *Attorney, Agent, or Firm* — ScienBiziP, P.C.

(57) ABSTRACT

A push-button on a device includes a shell of the device, an internal locking portion to connect with the device, a touch pole far away from the locking portion, and a supporting flange portion extending from the internal surface of the shell. The supporting flange portion and the device support each other. When the shell is pressed, the push-button elastically deforms as the locking portion 103 acts as a fixing point and the supporting end acts as a supporting point. The touch pole moves with the shell and the switch on a PCB is triggered to generate at least one signal.

10 Claims, 8 Drawing Sheets

(56) References Cited

U.S. PATENT DOCUMENTS

| | | | | |
|---|---|---|---|---|
| 2003/0174590 | A1 | 9/2003 | Arikawa et al. | |
| 2007/0251810 | A1* | 11/2007 | Corcoran | G06F 3/03543 200/276.1 |
| 2016/0267728 | A1* | 9/2016 | Saito | G07C 9/00944 |

* cited by examiner

PUSH-BUTTON STRUCTURE AND ELECTRONIC DEVICE WITH THE SAME

BACKGROUND

1. Technical Field

The subject matter herein generally relates to a pressing control structure, and more particularly to push-button structures and electronic devices with the same.

2. Description of Related Art

The push-button structure of an electronic device mainly includes a hole on the shell, and the push-button is coordinated with the hole. One kind of the push-button has restricted access and is located in the shell, users need to press the push-button by tool. Another kind of the push-button passes through the shell and is partly exposed from the hole, users operate by pressing the exposed part of the push-button. Both of the two push-button structures need a hole on the shell. For different push-buttons, the hole size, the hole location, and the hole fixing ways (hot melt, hook etc.) are different, increasing the cost. In addition, the hole on the shell influences the product appearance.

BRIEF DESCRIPTION OF THE DRAWINGS

Implementations of the present technology will now be described with reference to the attached figures.

DETAILED DESCRIPTION

Figure 1:
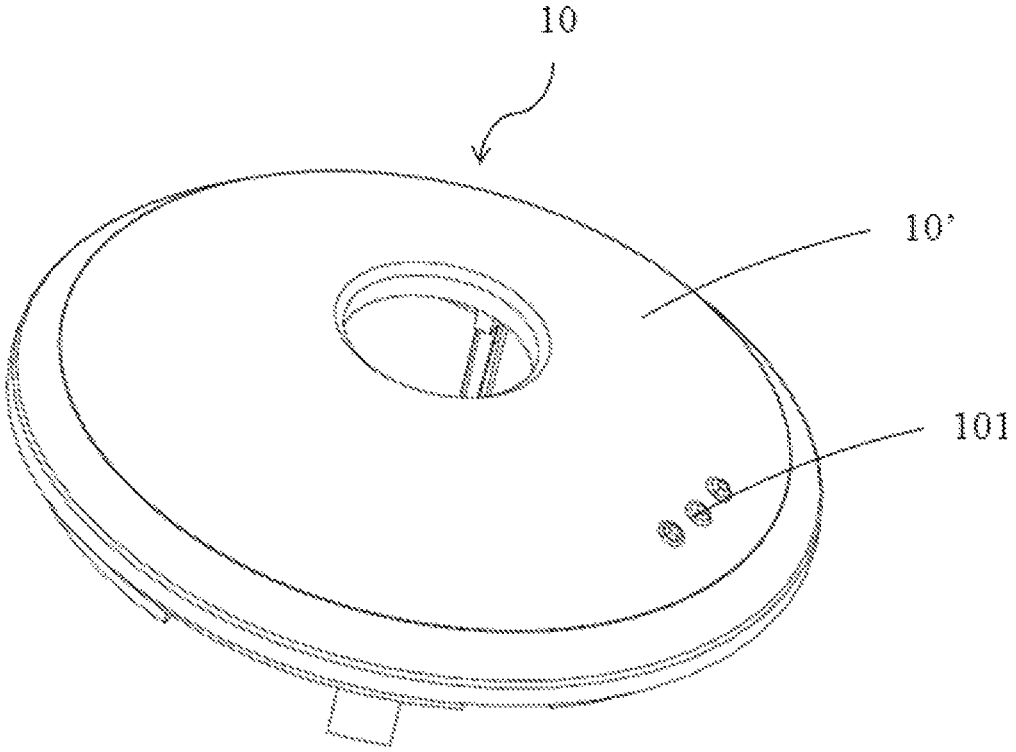
FIG. 1 is a perspective view of a push-button structure in accordance with an exemplary embodiment of the disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like reference numerals indicate the same or similar elements. It should be noted that references to "an" or "one" exemplary embodiment in this disclosure are not necessarily to the same exemplary embodiment, and such references can mean "at least one."

Figure 2:
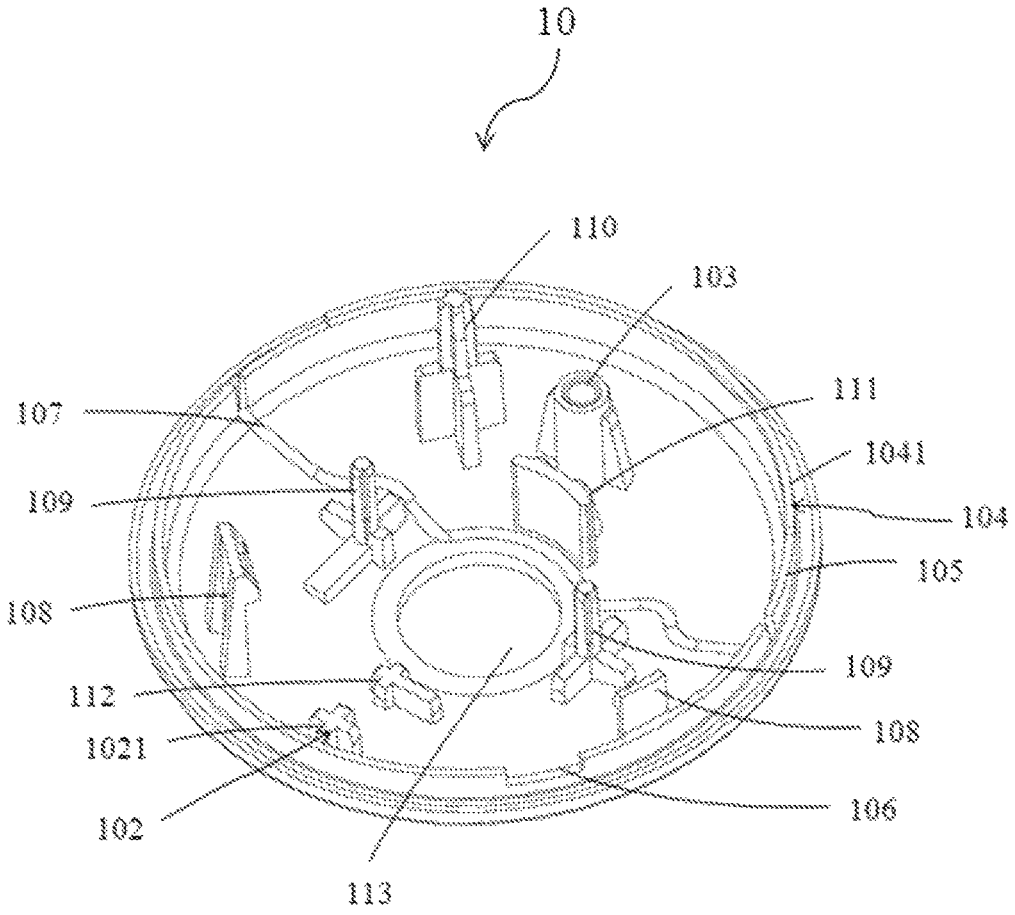
FIG. 2 is another perspective view of FIG. 1 from another angle.

FIG. 1 and FIG. 2 illustrate a push-button structure 10 with an internal surface and an external surface. The push button structure 10 includes a shell 10' and a mark area 101 on the external surface of the shell 10'. A touch pole 102, a locking portion 103, a supporting flange portion 104, a non-supporting flange portion 105, a groove 106, and an curved groove 107 are on the internal surface of the shell 10'. The mark area 101 is located on the external surface, and the location of the mark area 101 on the external surface corresponds to the location of the touch pole 102 on the internal surface. Thus, by their positioning at positions corresponding to each other, the mark area 101 indicates the location of the touch pole 102. Users can thereby determine the location of the touch pole 102 by reference to the mark area 101, and obtain the best pressing feeling through the mark area 101. In an exemplary embodiment, the mark area 101 can be anything which distinguishes the mark area 101, such as a block, an adhesive tape, a groove, or coloring.

The touch pole 102 is located on the internal surface corresponding to the mark area 101. The touch pole 102 includes a touch end 1021 to trigger a PCB to generate corresponding signals. The PCB is inside a related device, such as an electronic device, that is installed with the push-button structure 10. The locking portion 103 is on one side of the internal surface of the shell 10' for connecting with the related device. The touch pole 102 is on another side of the internal surface being spaced apart from the locking portion 103. The supporting flange portion 104 includes a supporting end 1041, the supporting end 1041 and the related device are pressed against each other.

Figure 3:
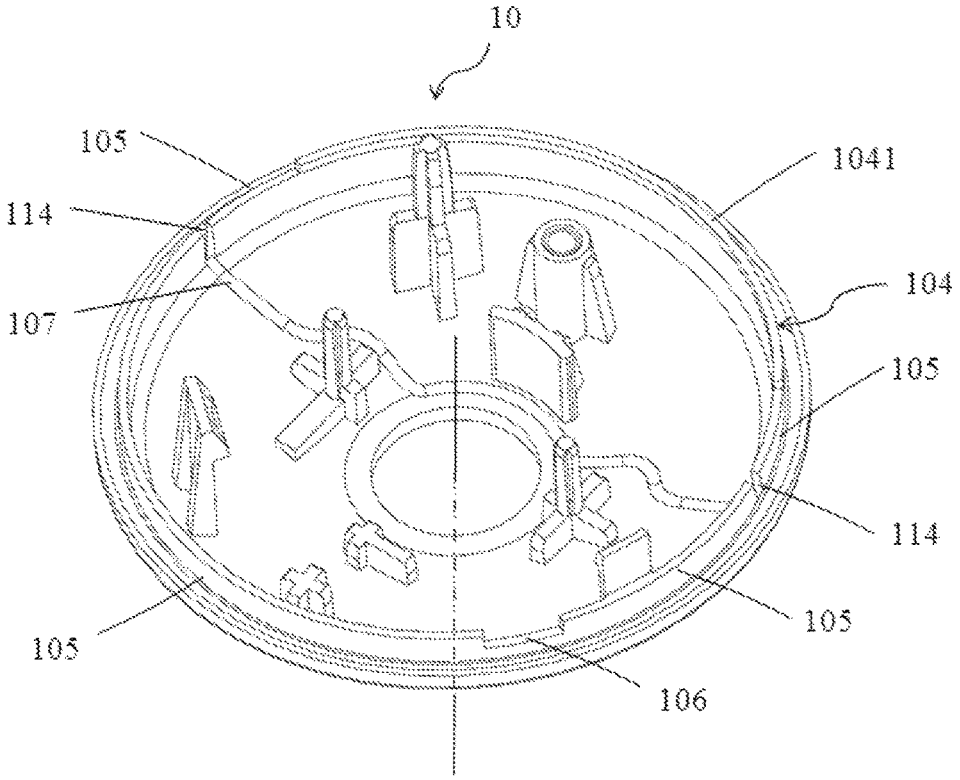
FIG. 3 is similar to FIG. 2 with details on a circular edge for the push-button structure.

Referring to FIG. 3, The shell 10' is circular. The supporting flange portion 104 and the non-supporting flange portion 105 extend from the internal surface of the shell 10' and are exposed from the internal surface. The non-supporting flange portion 105 is truncated by the curved groove 107 to form a notch 114. The supporting flange portion 104, the non-supporting flange portion 105, the groove 106 and the notch 114 define a circular edge. The supporting flange portion 104 on the circular edge has a radian, and the radian has a radial angle which is preferably 120 degrees, that is to say, the supporting flange portion 104 accounts for one third portion of the entire circular edge.

Figure 4:
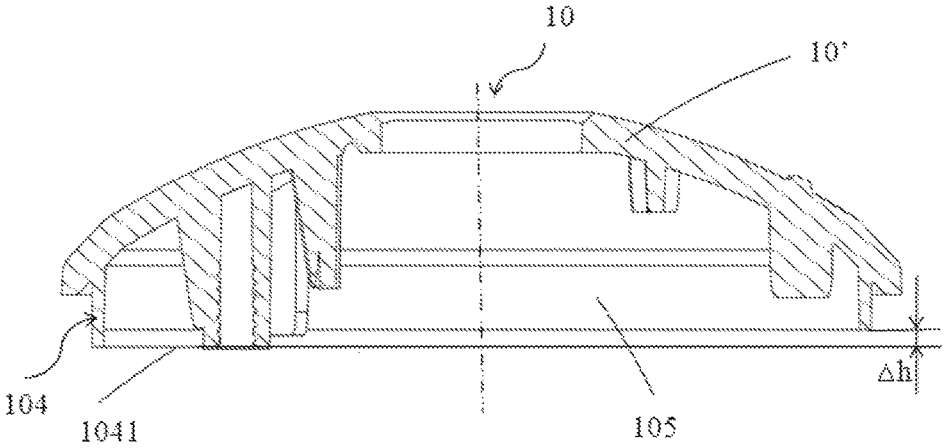
FIG. 4 is a cross-sectional view of the push-button structure in accordance with an exemplary embodiment of the disclosure.

The non-supporting flange portion 105 extends from the internal surface of the shell 10' and is located on the circular edge on which the supporting flange portion 104 is also located. The height of the non-supporting flange portion 105 extending from the internal surface of the shell 10' is smaller than the height of the supporting flange portion 104 extending from the internal surface of the shell 10'. As showing on FIG. 4, the supporting flange portion 104 and the non-supporting flange portion 105 have a height difference $\Delta h$. The non-supporting flange portion 105 can have a height smaller than the supporting flange portion 104, to form a certain gap with respect to the related device.

The groove 106 and the curved groove 107 can be different structures according to on the push-button 10 and the assembly of the related device. The groove 106 and the curved groove 107 make the push-button 10 more resilient.

When pressing the mark area 101, the shell 10' is deformed. Thus, the push-button 10 elastically deforms by taking the locking portion 103 as a fixing point. The touch pole 102 moves toward the related device and the touch end 1021 of the touch pole 102 triggers the related device to generate corresponding signal, and the button function is realized. The range of the supporting end 1041 of the supporting flange portion 104 that occupies on the circular edge determines the area that presses against the related device, and will be used to match with different sizes of push-buttons. Since the non-supporting flange portion 105 and the related device form a large gap between them, if the non-supporting flange portion 105 is omitted, the push-button 10 can move downward entirely to prevent portions of the shell 10' surrounding the mark area 101 from being only partly deformed when the push-button structure 10 is pressed.

Figure 5:
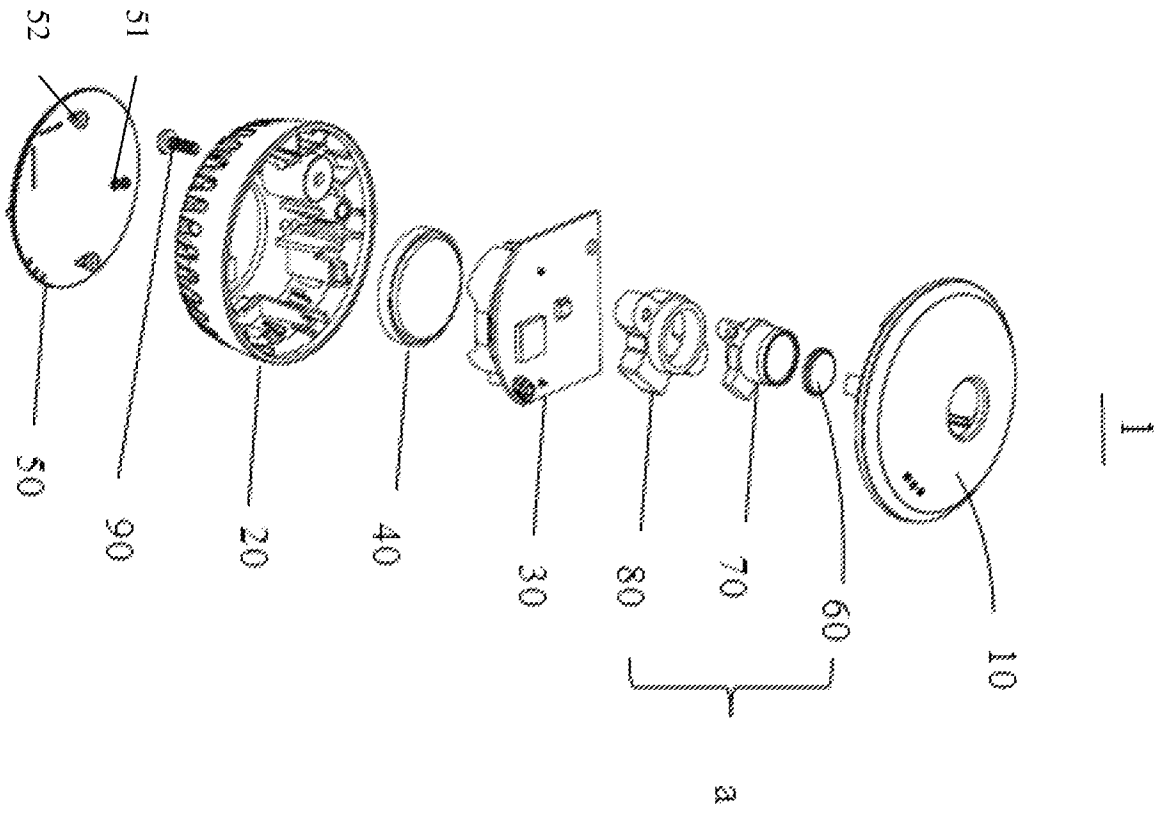
FIG. 5 is an exploded perspective view of an electronic device with the push-button structure in FIG. 1.

FIG. 5 illustrates an electronic device with the push-button structure 10. The electronic device includes the push-button structure 10, a body 20, a light guide assembly (a), a PCB 30, a cell 40, a cell cover 50, and a connecting portion 90. The light guide assembly (a) includes an epoxy 60, a light guide post 70, and a shading cover 80. The light guide assembly (a) is connected with the push-button 10.

Figure 6:
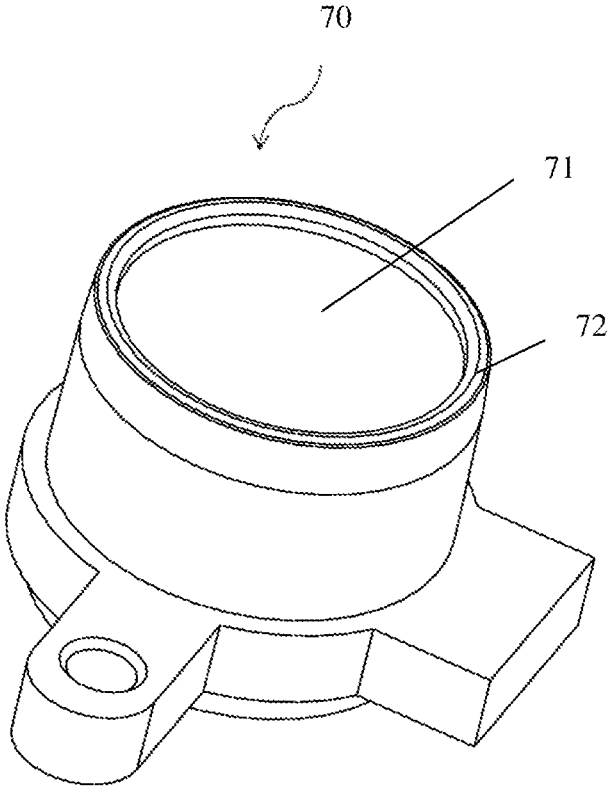
FIG. 6 is a perspective view of a light guide post in FIG. 5.

In other exemplary embodiments, referring to FIG. 2, FIG. 5 and FIG. 6, to assemble the body 20 and the light guide assembly (a), the push-button 10 further includes a top latching portion 108, an insert 109, a mounted pole 110, a blocking portion 111, and a resisting block 112. The push-button structure 10 has a central hole 113. The insert 109, the blocking portion 111, and the resisting block 112 are mounted with the light guide assembly (a), the light guide assembly (a) passes through the central hole 113 of the push-button structure 10. The light guide post 70 has a top surface 71 and a rim 72, the rim 72 extends from the top surface 71 to receive a portion of the epoxy 60. The rim 72 is arranged between the central hole 113 and the epoxy 60, and is exposed. Therefore, a light ring forms when the light irradiates the light guide post 70 as light comes through the exposed rim 72. The mounted pole 110 is mounted with the body 10, the top latching portion 108 can be a hook or latch to couple with the body 20, or PCB in the body 20, to avoid tilting of the push-button structure 10.

Figure 7:
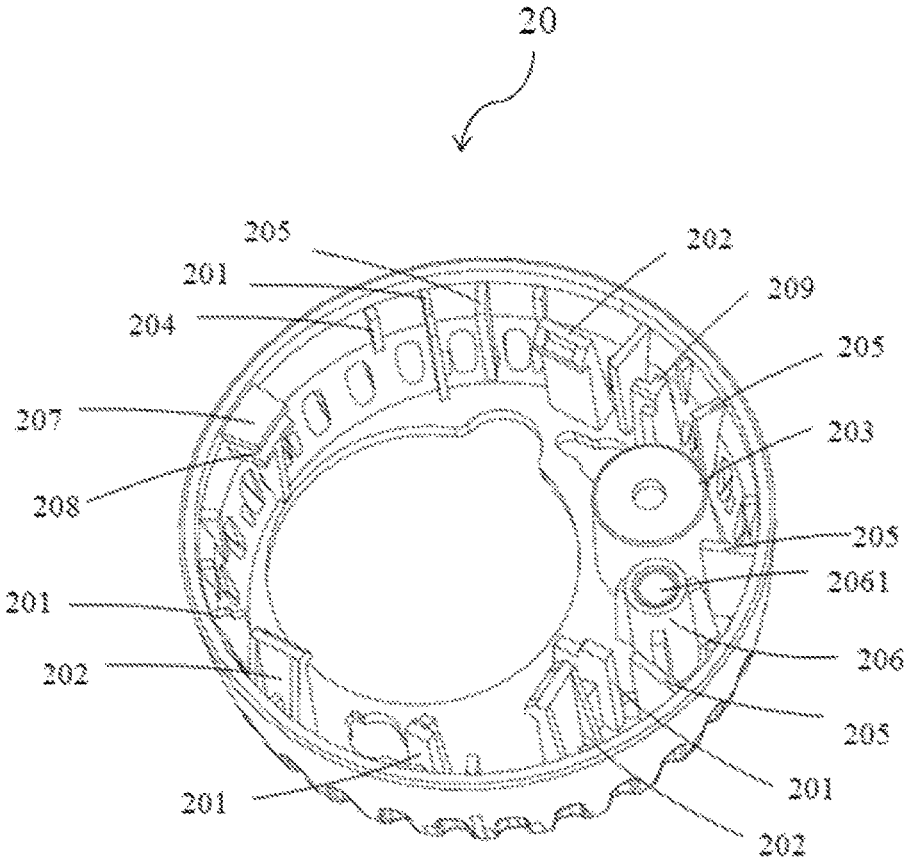
FIG. 7 is a perspective view of a push-button structure body in accordance with an exemplary embodiment of the disclosure.

FIG. 7 illustrates the body 20. The body 20 includes a holding block 201, a bottom latching portion 202, a locking sleeve 203, a plurality of ribs 204, a plurality of strengthening ribs 205, a mounted sleeve 206, an embedded block 207, a supporting post 209, a first through hole 210 (shown in FIG. 8), an installation hole (not shown in figures), and a stop hole (not shown in figures) in the bottom surface of the body 20. The PCB has a top surface and a bottom surface, the holding block 201 and the supporting post 209 support the bottom surface of the PCB 30. The bottom latching portion 202 couples to the top surface of the PCB 30. In an exemplary embodiment, the bottom latching portion 202 can be a hook or a latch. Moreover, the locking sleeve 203 includes a second through hole 2031 (shown in FIG. 8) and the mounted sleeve 206 includes a blind hole 2061. The pluralities of ribs 204 and 205 on the body 20 support the supporting flange portion 104 of the push-button 10. Also the pluralities of ribs 204 and 205 limit the moving distance of the non-supporting flange portion 105 when the push-button 10 is pressed. The ribs 205 strengthen the structure of the body 20. The insert 109 comprises two parallel blocks extending from the side of the body 20, and an embedded groove 207 is formed between the two parallel blocks.

Figure 8:
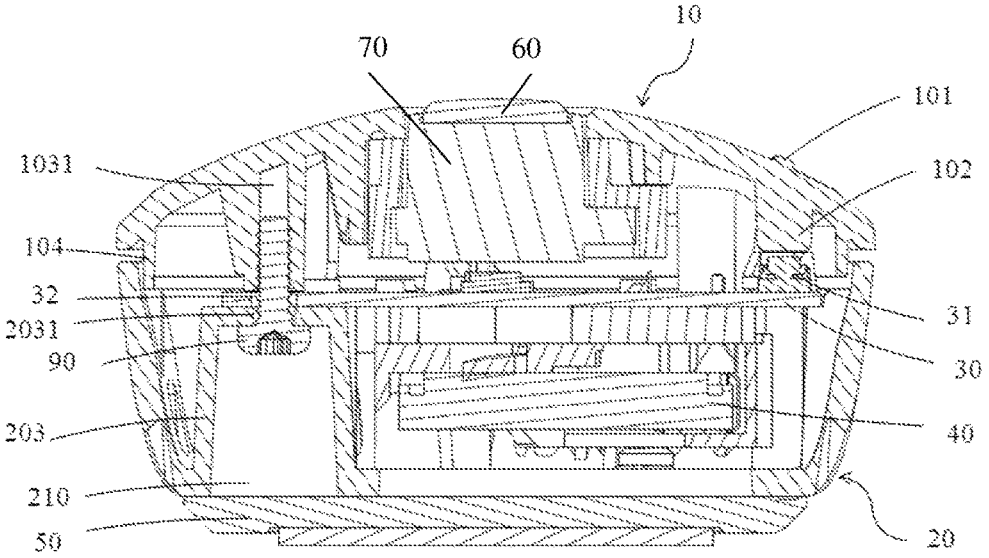
FIG. 8 is a cross-sectional view of the electronic device in accordance with an exemplary embodiment of the disclosure.

FIG. 8 illustrates cross-sectional view of the electronic device. The PCB 30 has a switch 31 on one side, and a third through hole 32 on another side. An LED is on the center of the PCB 30 and the switch 31 and the LED are on the top surface of the PCB 30.

A cell cover 50 on the top has a protrusion 51 and two posts 52 symmetrical on two sides. The protrusion 51 couples with the installation hole, and the two posts couple with the stop hole of the bottom surface of the body 20.

In the exemplary embodiment, the connecting portion 90 is a screw. The connecting portion 90 passes through the first through hole 210 of the body 20 and the second through hole 2031 of the locking sleeve 203 to couple with the inner screw thread 1031 of the locking portion 103, to secure the push-button structure 10 on the body 20.

When the electronic device is assembled, the PCB 30 is received in the inner chamber of the body 20. The cell 40 is received in the cell chamber under the PCB 30. One side of the PCB 30 slides into the embed groove 208 of the embedded block 207. The bottom latching portion 202 of the body 20 couples to the top surface of the PCB 30. The holding block 201 of the body 20 holds the PCB 30. The supporting post 209 of the body 20 supports the bottom surface of the PCB 30, and the PCB is fastened in the body 20. The push-button structure 10 is latched or buckled into the body 20. The top latching portion 108 couples to the bottom surface of the PCB. The mounted pole 110 is inserted into the blind hole 2061 of the mounted sleeve 206. The connecting portion 90 passes through the first through hole 210 of the body 20. The second through hole 2031 of the locking sleeve 203 and the third through hole 32 couple with the inner screw thread 1031 of the locking portion 103, and the push-button 10 is thus secured on the body 20. The cell cover 50 passes through the installation hole of the body 20. The protrusion inserts into the stop hole after the rotation of the cell cover 50, and the cell cover 50 is fastened to the body 20.

The support end 1041 of the supporting flange portion 104 and the pluralities of ribs 204 and 205 of the body 20 support each other. The support end 1041 of the supporting flange portion 104 contacts with the ribs 204 and 205 of the body 20. The supporting end 1041 and the ribs 204 and 205 are pressed against each other. The non-supporting flange portion 105 and the pluralities of ribs 204 and 205 form a gap therebetween to limit the moving distance of the push-button 10 when the push-button is pressed. When the electronic device is not in normal operation, for example is in idle mode, the touch end 1021 of the touch pole does not contact the switch 31 on the PCB 30. Since the supporting flange portion 104 and the non-supporting flange portion 105 act as parts of the push-button 10, if the non-supporting flange portion 105 is omitted, the push-button 10 can move downward entirely to prevent portions of the shell 10' surrounding the mark area 101 from being only partly deformed when the push-button structure 10 is pressed.

When the push-button 10 is in operation and when the mark area 101 of the push-button 10 is pressed, the support end 1041 and the electronic device are pressed against each other. Because the non-supporting flange portion 105 and one side of the body 20 form a gap, the push-button 10 near the mark area 101 moves downward. Finally, the non-supporting flange portion 105 moves downward and is stopped by the ribs 204 and 205 to avoid excess movement by the push-button 10 and excessive deformation around the mark area 101. Users can obtain the best pressing feeling by changing the length of the supporting flange portion 104. The touch pole 102 contacts the switch 31 to generate a signal. In addition, the push-button in the exemplary embodiment is of plastic material. The push-button and the body structure can be circular, and may be square or other shapes.

The exemplary embodiments shown and described above are only examples. Many details are often found in the art such as the other features of a push-button and electronic device with the same. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. An electronic device, comprising:

a push-button structure, comprising:

a shell;

a locking portion on one side of an internal surface of the shell, the locking portion for connecting with a related device;

a touch pole on another side of the internal surface being spaced apart from the locking portion; and a supporting flange portion extending from the internal surface, the supporting flange portion comprising a supporting end to support with the related device;

wherein when an external force is applied to the shell, the shell elastic deforms, the locking portion acts as a fixing point and the supporting end as a supporting point, and the touch pole is moved with the shell;

a body coupled to the shell; and a printed circuit board located in the body and connected to the body, the printed circuit board comprising a switch and a cell chamber for receiving a cell;

wherein the switch is on a top surface of the printed circuit board and the cell chamber is on a bottom surface of the printed circuit board; wherein when the external force is applied to the shell, the touch pole contacts the switch to generate a signal, wherein the electronic device further comprises a light guide assembly, the light assembly comprises a light guide post, a shading cover and an epoxy.

2. The electronic device of claim 1, wherein the body comprises a locking sleeve, the body has a first through hole, the locking sleeve has a second through hole, the printed circuit board has a third through hole, and the third through hole is away from the switch.

3. The electronic device of claim 2, wherein the electronic device further comprises a connecting portion passing through the first through hole, the second through hole and the third through hole; and wherein the locking portion is secured on the shell.

4. The electronic device of claim 1, wherein the body has a plurality of ribs extending therefrom, the supporting flange portion contacts the plurality of ribs; and wherein a non-supporting flange portion and the plurality of ribs form a gap therebetween.

5. The electronic device of claim 4, wherein the body further comprises a bottom latching portion, an embedded block and a supporting post, the bottom latching portion couples to the top surface of the printed circuit board, the embedded block defines an embed groove, wherein one side of the printed circuit board slides into the embed groove, and the supporting post supports the bottom surface of the printed circuit board.

6. The electronic device of claim 5, wherein the body further comprises a mounted sleeve, the push-button structure comprises a mounted pole, the mounted sleeve has a blind hole, and the mounted pole inserts into the blind hole.

7. The electronic device of claim 6, wherein the push-button structure comprises a top latching portion and a resisting block on the external surface of the push-button structure, the top latching portion couples to the bottom surface of the printed circuit board, the resisting block resists against the top surface of the printed circuit board.

8. The electronic device of claim 1, wherein the push-button structure comprises an insert, a blocking portion, and a central hole, the insert and the blocking portion are mounted to the light guide assembly, and the light guide assembly passes through the central hole of the push-button structure.

9. The electronic device of claim 8, wherein the light guide post has a top surface and a rim, and the rim extends from the top surface to receive a portion of the epoxy.

10. The electronic device of claim 9, wherein the rim is arranged between the central hole and the epoxy, and is exposed, and a light ring forms when the light irradiates the light guide post and the light come out from the rim.

* * * * *